United States Patent [19]

Zullo

[11] Patent Number: 4,502,261

[45] Date of Patent: Mar. 5, 1985

[54] FEELER PINS DEVICE FOR CIGARETTE GROUPS

[75] Inventor: Antonio Zullo, Bologna, Italy

[73] Assignee: Sasib S.p.A., Bologna, Italy

[21] Appl. No.: 382,805

[22] Filed: May 27, 1982

[30] Foreign Application Priority Data

Jun. 2, 1981 [IT] Italy ..... 15168/81[U]

[51] Int. Cl.[3] ..... B65B 57/10

[52] U.S. Cl. ..... 53/54; 53/148; 53/150; 53/499

[58] Field of Search ..... 53/499, 54, 149, 152, 53/494, 495, 498, 148, 150; 200/61.41; 198/502, 503, 419; 209/535, 536, 537, 936, 600; 73/81, 800, 819, 862.53, 862.01; 131/280, 908, 909, 910

[56] References Cited

U.S. PATENT DOCUMENTS

| | | | |
|---|---|---|---|
| 1,972,657 | 9/1934 | Kidd | 53/54 |
| 2,854,538 | 9/1958 | Bergman | 200/61.41 |
| 3,590,550 | 7/1971 | Gianese | 53/54 |
| 3,874,227 | 4/1975 | Focke | 209/535 X |
| 3,964,041 | 6/1976 | Hinds | 340/258 |
| 4,042,918 | 8/1977 | Klitzman | 340/280 |
| 4,134,486 | 1/1979 | Grone | 198/466 |

FOREIGN PATENT DOCUMENTS

| | | | |
|---|---|---|---|
| 811901 | 10/1936 | France | 53/494 |
| 745236 | 2/1956 | United Kingdom . | |
| 955068 | 4/1964 | United Kingdom . | |

*Primary Examiner*—John Sipos
*Assistant Examiner*—Donald R. Studebaker
*Attorney, Agent, or Firm*—Spencer & Frank

[57] ABSTRACT

A feeler device for sensing the number of cigarettes arranged in groups, particularly groups of three rows, at the interior of a group-forming pocket, includes a plurality of feeler pins which are arranged parallel in the longitudinal direction of the cigarettes and which can be introduced into the group-forming pocket through an open end thereof in order to detect the cigarettes which are misplaced or dislocated, the feeler pins are arranged excentrically and the line connecting the feeler pins of each cigarette row is a zig-zag line.

4 Claims, 2 Drawing Figures

FEELER PINS DEVICE FOR CIGARETTE GROUPS

BACKGROUND AND SUMMARY OF THE INVENTION

This invention relates to devices for sensing or detecting the number of cigarettes (or other rod-like articles) forming an orderly group of cigarettes housed in a tubular pocket and intended to be packed, said detecting devices comprising a detecting or feeler head provided with a plurality of feeler pins parallel to one another and slidably mounted so as to move axially and resiliently in said detecting head with an arrangement corresponding to that of the cigarettes forming the group of cigarettes, said detecting head with its feeler pins being softly pressed against the substantially coplanar facing ends of the cigarettes, whereby the feeler pins engaging a cigarette will resiliently collapse and the absence of collapse will indicate the absence of the respective cigarette in the group of cigarettes and will generate a "defect" electric signal that can be used in any suitable manner, for example to discard later on the package containing said defective group of cigarettes.

In some conventional detecting devices of the type specified above, each feeler pin has associated therewith an electrical contactor that will be closed when the feeler pin engages a cigarette and is, therefore, displaced toward the interior of the detecting head. All these electrical contactors are serially connected with each other and form a part of an electrical circuit that will remain in the opened condition when even one feeler pin does not engage a cigarette and, therefore, is not displaced so as to close the contact associated therewith.The absence of a cigarette, therefore, causes the detecting circuit to remain opened, and this electrical condition is stored in a memory means to cause, the package having the defective group of cigarettes to be discarded.

In another conventional sensing device of the specified type, the feeler pins that engage the cigarettes are resiliently displaced by the latter and remove screens that normally prevent suitable light beams (emitted, for example, by suitable sources such as light emitting diodes) from impinging on light-responsive elements, such as phototransistors, so as to create an electrical signal indicating whether the condition of the detected cigarette group is regular.

The invention is not concerned with the operation and devices by means of which the feeler pins generate a signal indicating whether the condition of the detected group of cigarettes is regular or defective, that is, whether the required number of cigarettes is present or whether even one cigarette is absent. The invention, instead, deals with another problem concerning the detecting devices as specified above. In fact, in the known devices of this type, the axes of the feeler pins are substantially in register with the axes of the positions where the cigarettes should be theoretically. It may happen, however, that in case one or more cigarettes are absent, the other cigarettes of the group will assume positions so as to engage all the feeler pins,i.e., so that one or more cigarettes are engaged by two feeler pins. In this circumstance, the detecting device would issue a wrong response, indicating a regular group of cigarettes, i.e., formed by the pre-established entire number of cigarettes, even if one or more cigarettes are missing.

The object of this invention is to eliminate this drawback, that is, to improve the detecting devices of the specified type so as to assure at all times a correct response concerning whether the number of cigarettes forming the detected group of cigarettes is complete or incomplete.

This object is achieved by this invention by locating some of the feeler pins of the detecting head excentrically with respect to the prospective positions of the cigarettes of the orderly group of cigarettes, rather than exactly coaxially with respect to said pre-established positions, so that if one or more cigarettes are absent and the remaining cIgarettes are misplaced, none of the latter can be engaged by two feeler pins simultaneously.

BRIEF DESCRIPTION OF THE DRAWINGS

The particular features of the invention and the advantages resulting therefrom will be apparent from the following description made with reference to the accompanying drawings, wherein.

DESCRIPTION OF THE PREFERRED EMBODIMENTS

Figure 1:
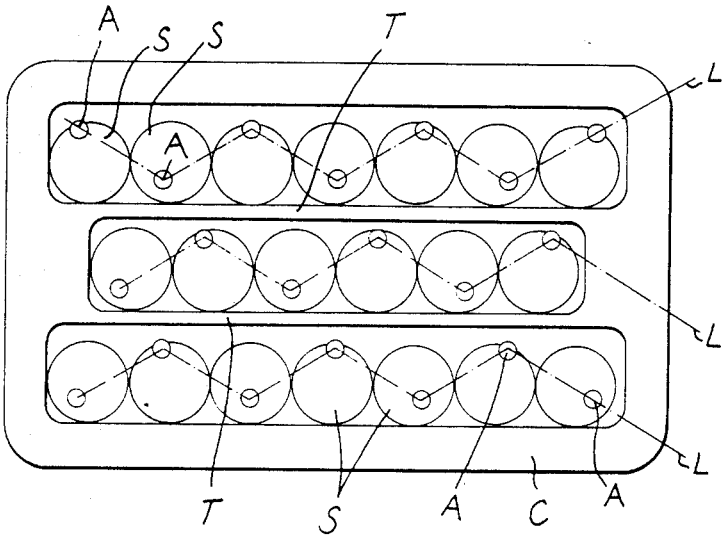
FIG. 1 shows diagrammatically the arrangement of the feeler pins according to the invention with respect to a group of cigarettes housed in a pocket comprising internal partitions.
Figure 2:
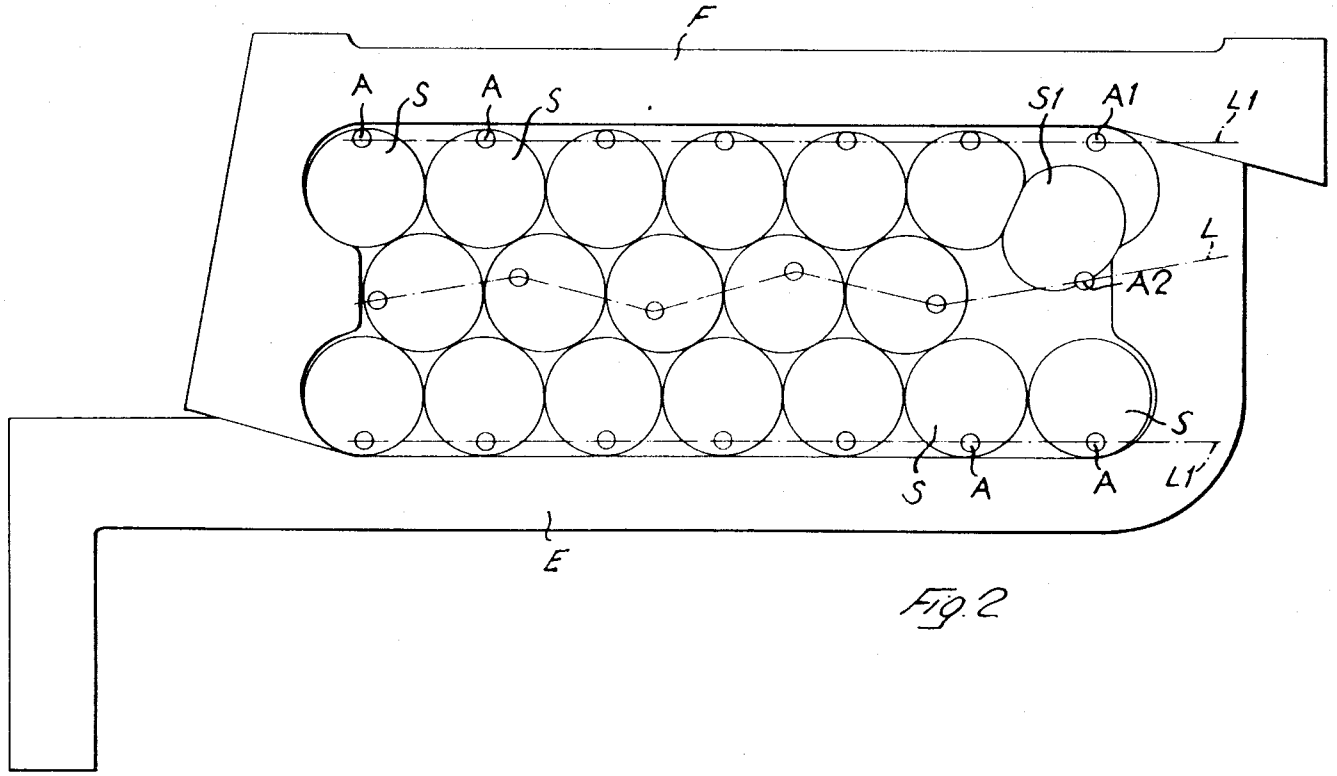
FIG. 2 shows the arrangement of the feeler pins of the device according to the invention with respect to a group of cigarettes housed in a cell of the compressor drum of a cigarette-packing machine.

With reference to the Figures, the cigarettes of an orderly group of twenty cigarettes to be packed are indicated by S. In FIG. 1, the group of cigarettes is complete and is housed in a pocket C comprising internal partitions T. On the other hand, FIG. 2 shows the group of cigarettes S housed in a cell formed by two L-shaped members E and F forming a part of the compressor drum of a cigarette-packing machine. The cell of FIG. 2 is not provided with partitions between the layers of cigarettes S, and the group of cigarettes S is compact, but it is incomplete because one cigarette is missing in the middle layer at the right-hand portion of the cell.

In both the embodiments of FIGS. 1 and 2, when one or more cigarettes S are missing from the group of twenty cigarettes to be packed, the remaining cigarettes can be misplaced in the respective pocket C or in the cell E, F. This misplacement is apparent in the case of FIG. 1, where the individual layers of cigarettes are separated from one another by the partitions T of the pocket C and are loosely housed in the respective compartments. The misplacement of the cigarettes of an incomplete group of cigarettes can happen also in the case of FIG. 2, despite of the staggered arrangement of the cigarettes, which directly contact to one another so as to form a compact group. In fact, also in this case, since when checking the number of cigarettes forming a group of cigarettes the pressure on the group is released, clearances will be formed between the cigarettes and the walls of the cell. Moreover, some cigarettes could be ovalized, or they could have distorted circumferences. Also, the stepwise rotation of the compressor drum generates shaking movements which tend to cause the cigarettes to be misplaced.

The device according to the invention for detecting the number of cigarettes S forming a group of cigarettes to be packed comprises the following members which are known per se: a detector head (not shown) carrying a set of twenty feeler pins parallel to one another and mounted, in a resiliently collapsible way, in said detecting head. In FIGS. 1 and 2, these feeler pins are shown by small circles A. The detecting head is moved toward the group of cigarettes with a movement which is parallel to the axes of the cigarettes S and feeler pins A. When all the feeler pins A engage a cigarette and are stopped thereby and, therefore, are pushed resiliently toward the interior of the detecting head, the group of cigarettes is considered to be complete, i.e. formed by twenty cigarettes as required. On the other hand, when one or more feeler pins do not engage any cigarette and are not pushed toward the interior of the detectIng head, the group of cigarettes is considered to be incomplete and a "defect" electrical condition is created and stored in a memory means so that the package containing the incomplete group of cigarettes can be discarded later on.

In order to invariably obtain from the detecting device a correct response concerning the number of cigarettes forming a group of cigarettes to be packed, even when, one or more cigarettes are absent and the remaining cigarettes are misplaced in the pocket C or in the cell E, F, the feeler pins have an arrangement which corresponds only approximately to that of the cigarettes S of the group. In particular, the feeler pins are not co-axial with respect to the pre-established positions of the individual cigarettes in the group. Instead, the feeler pins are provided at positions that are considerably excentric with respect to the centers of the cigarettes but that remain within the circumferences of the cigarettes in the pre-established positions, so that none of the cigarettes can be engaged simultaneously by two feeler pins in the event that one or more cigarettes are absent and the remaining cigarettes are misplaced.

In FIG. 1 the feeler pins A, which correspond to the cigarettes S of each layer of cigarettes in the three compartments of said pocket C which are formed by said partitions, are positioned at the apexes of imaginary zig-zag lines L and are located at very excentric positions with respect to the corresponding cigarettes S, in proximity to the peripheries thereof. The top imaginary zig-zag line L, at the apexes of which are the feeler pins A corresponding to the cigarettes S of the upper layer or compartment, is staggered "a half wave length" with respect to the bottom imaginary zig-zag line L, for the bottom layer or compartment. The imaginary zig-zag line L joining the feeler pins A corresponding to the cigarettes S of the intermediate layer or compartment is staggered "one fourth of a wavelength" with respect to the top and bottom layers.

In FIG. 2, the feeler pins A of both the upper and lower layers of cigarettes S are all considerably staggered outwards in opposite directions, i.e., upwards at the upper layer and downwards at the lower layer, and are located on imaginary straight lines L1 which are substantially parallel to the longitudinal intermediate plane between the upper and lower layers. The feeler pins associated with the intermediate layer of cigarettes S, however, are located at the apexes of an imaginary zig-zag line L, of comparatively shallow configuration, and are also located excentrically with respect to the corresponding cigarettes S.

The advantages of the detecting device according to the invention are also apparent in FIG. 2. In fact, this Figure illustrates a case wherein one cigarette is missing at the right-hand portion of the intermediate layer of cigarettes, while the cigarette S1 that should be at the corresponding end of the upper layer is misplaced in a position between the upper and intermediate layers. This misplaced cigarette has also been distorted. If the feeler pins were located in the conventional known arrangement, i.e., exactly coaxially with respect to the expected positions of the cigarettes S of the orderly group of cigarettes in the cell E, F, the misplaced cigarette S1 would be engaged by two feeler pins associated with the corresponding end (right-hand) cigarettes of the upper and intermediate layers of cigarettes, so that a signal, incorrectly indicating a complete group of cigarettes would be issued. The arrangement of the feeler pins according to the invention, obviously, eliminates this inconvenience, because the misplaced cigarette S1 is engaged only by one feeler pin A2, even if the latter is not the feeler pin A1 which is associated with the original pre-established position of the misplaced cigarette S1. Therefore, a correct signal is issued, because one feeler pin (A1) does NOT engage a cigarette and, therefore, will not be displaced, so that an electrical signal indicating the absence of one cigarette (incomplete group) is generated.

I claim:

1. In a feeler device for sensing the number of rod-like articles which have ends and which form an orderly group of articles of more than one row housed in a tubular pocket, the ends of the articles in the group normally being substantially co-planar and having predetermined positions, said feeler device including a feeler head having a plurality of feeler pins which have axes that are parallel to one another and which are slidably mounted so as to move resiliently and axially in said feeler head, said feeler head being softly pushed with its feeder pins in a direction parallel to the axes of said feeler pins against the substantially co-planar ends of the articles so that the feeler pins engaging the ends of corresponding articles will be resiliently displaced in order to detect the absence of an article in the group, the improvement wherein: means for mounting at least some of the feeler pins on said feeler head considerably excentrically with respect to the corresponding predetermined positions of the ends of the articles in the group and at a distance from at least one adjacent pin greater than the diameter of said articles, so that if one or more articles are absent and the remaining articles are misplaced, none of the misplaced articles can be engaged by two feeler pins simultaneously.

2. A device according to claim 1, wherein the group of articles is formed by three layers of articles, wherein the feeler pins are positioned to engage the ends of corresponding articles adjacent the peripheries thereof, and wherein the feeler pins for each layer are located at the apexes of an imaginary zig-zag line, each of these imaginary zig-zag lines being staggered longitudinally with respect to at least one adjacent zig-zag line.

3. A device according to claim 1, wherein the group of articles is formed by an intermediate layer between two outer layers of articles, wherein the feeler pins for the intermediate layer are located at the apexes of an imaginary zig-zag line, and wherein the feeler pins for each of the two outer layers are located in proximity to the peripheries of the ends of the corresponding articles of an imaginary substantially straight line positioned substantially outwardly with respect to a line running through the center of the ends of the corresponding layer of articles.

4. A device according to claim 2, wherein the zig-zag lines have wavelengths, and wherein at least one zig-zag line is staggered with respect to another zig-zag line by about half a wavelength.

* * * * *